US005549459A

United States Patent [19]

Nixon

[11] Patent Number: 5,549,459

[45] Date of Patent: *Aug. 27, 1996

[54] RADIAL BEARING ASSEMBLY FOR A HIGH INTERTIA FLYWHEEL OF A CANNED MOTOR PUMP

[75] Inventor: Donald R. Nixon, Murrysville, Pa.

[73] Assignee: Westinghouse Electric Corporation, Pittsburgh, Pa.

[ * ] Notice: The term of this patent shall not extend beyond the expiration date of Pat. No. 5,356,273.

[21] Appl. No.: 322,085

[22] Filed: Oct. 12, 1994

Related U.S. Application Data

[63] Continuation-in-part of Ser. No. 175,866, Dec. 30, 1993, Pat. No. 5,356,273.

[51] Int. Cl.[6] ..... F04B 35/04

[52] U.S. Cl. ..... 417/423.12; 417/424.1; 415/229

[58] Field of Search ..... 417/423.1, 423.12, 417/423.2, 424.1; 415/229; 384/309, 311, 312, 625, 907.1

[56] References Cited

U.S. PATENT DOCUMENTS 1,920,723 8/1922 Wallgren et al. .

1,920,724 8/1933 Wallgren et al. ..... 384/312

1,921,957 8/1933 Wallgren et al. .

2,094,137 9/1937 Wallgren ..... 384/309

3,450,056 6/1969 Heathcote et al. ..... 417/423.12

4,734,009 3/1988 Campbell et al. .

4,864,703 9/1989 Biondetti et al. .

*Primary Examiner*—Charles Freay

[57] ABSTRACT

A canned motor pump includes a main housing with a rotatable shaft carrying an impeller, a high inertia flywheel mounted on the shaft, and a bearing housing stationarily mounted to the main housing. The bearing housing contains a convex radial bearing assembly pivotally mounted on an outer circumferential surface thereof for engagement with a bearing surface on an inner diameter of the flywheel. One embodiment of the convex radial bearing assembly employs a pad made of a self-lubricating, hard material and engageable with a hard metal surface on the inner diameter of the flywheel, and a second embodiment of the convex radial bearing assembly employs a pad with a hard metal surface on the outer diameter of the bearing housing and engageable with a sleeve made of a self-lubricating, hard material and located on the inner diameter of the flywheel.

17 Claims, 5 Drawing Sheets

RADIAL BEARING ASSEMBLY FOR A HIGH INTERTIA FLYWHEEL OF A CANNED MOTOR PUMP

PRIOR APPLICATION

This application is a continuation-in-part application of application Ser. No. 175,866, filed Dec. 30, 1993, now U.S. Pat. No. 5,356,273.

BACKGROUND OF THE INVENTION

1. Field of the Invention

This invention relates generally to a canned motor pump with a high inertia flywheel and, more particularly, to a radial bearing assembly for a rotatable motor shaft on which the flywheel is mounted.

2. Background of Information

Centrifugal pumps having flywheels are well-known. The flywheel is incorporated to mechanically store kinetic energy during operation of the pump, which energy may be utilized to maintain rotation of the pump in the event of loss of motive power, such as loss of electric power. In nuclear reactors, this technology becomes very important in order to help maintain coolant circulation through the reactor core after coolant pump trip, since the nuclear fuel continues to give off substantial amounts of heat within the first several minutes after a reactor trip, and cooling is improved with forced flow. The flywheel is generally a metal disk having relatively high mass and being precisely attached to or mounted on the motor shaft for rotation therewith, the inertia of which keeps the shaft rotating after de-energization of the motor.

Pressurized water reactor (PWR) coolant pumps generally include a pump and a motor separated by a complicated shaft seal system, the seals being used as a part of the reactor coolant system pressure boundary. The seals are generally subject to about a 2500 psi pressure differential between the reactor coolant system and the containment atmosphere. These seals are susceptible to failure, and may cause a non-isolatable leak of primary coolant ranging in size from very small to fairly large. As such, seal failure may result in a challenge to the redundant safety systems provided in nuclear power plants to prevent and mitigate damage to the reactor core.

Canned pumps have been used in nuclear reactor plants for some time, and avoid the problem of the shaft seal arrangement since the entire pump, including bearings and rotor, are submerged in the pumped fluid. Therefore, the use of the pump expressly reduces the potential for a small loss of coolant accident (LOCA). Exemplary canned motor pumps are described in U.S. Pat. Nos. 3,450,056 and 3,475,631. In boiling water reactors, continued rotation of these pumps upon loss of electric power is provided by electro-mechanical means, generally in the form of a motor-generator set and typically located outside of the reactor containment for accessibility purposes, the electricity being transmitted from the generator to the pump motor through containment wall penetrations. In the event of a loss of electric power to the motor-generator set, the flywheel maintains rotation of the generator for some period of time, which continues to provide power to the pump motor. However, due to the lack of mechanical inertia in the pump itself, any localized failures of the pump or its controls may prevent the pump from extended coast-down. In addition, due to the necessity for extra equipment, this option becomes fairly expensive, both in capital cost and in operation and maintenance cost.

A flywheel within a canned or wet winding pump has been utilized. However, the losses resulting from spinning a large, high mass flywheel through the fluid contained in the pump casing are substantial. The outer surfaces of the flywheel attempt to frictionally pump the surrounding fluid, while the casing surrounding the flywheel inhibits fluid flow. Therefore, turbulent vortices form causing highly distorted fluid velocities which yields substantial drag on the flywheel. This drag is a function of the speed and area of the surface of the flywheel, which both increase with the radius of the flywheel, such drag being commonly understood to increase with about the fifth power of the diameter and about the cube of the angular velocity.

One arrangement to overcome this power loss is disclosed in U.S. Pat. No. 4,084,924 to Ivanoff et al. This patent describes a wet winding pump having a flywheel and a free-wheeling shroud rotatable relative to the shaft and the flywheel. The shroud encompasses the flywheel but is spaced apart therefrom and includes passages for ingress and egress of liquid into and out of the space between the flywheel and the shroud. This system envisions that the shroud will rotate at some angular velocity which would be approximately one-half the velocity of the flywheel, thereby creating two pumped fluid layers, one (between the flywheel and the shroud) being pumped by the flywheel, and the other (the layer outside the shroud) being pumped by the shroud. The lower relative angular velocity between the rotating surfaces therefore results in lower total drag.

A further high inertia flywheel for a canned or wet winding pump that purportedly prevents vibration of the pump, and simultaneously minimizes the losses associated with the flywheel is disclosed in U.S. Pat. No. 4,886,430 to Veronesi et al. on Dec. 12, 1989, assigned to the Westinghouse Electric Corporation. U.S. Pat. No. 4,886,430 describes a radial bearing located on the outer circumferential surface of the flywheel. The small gaps between the flywheel surface facings and the radial and thrust bearing surfaces were theorized as reducing the friction loss of the flywheel. However, testing of the flywheel and bearing arrangement described in this U.S. Pat. No. 4,886,430 showed that the expected drag reduction did not occur. Subsequent analysis revealed that close clearances, such as those in the journal bearings, increase rather than reduce drag. The analysis was proven by testing that showed a 30% drag reduction when the close clearance radial bearing pads were replaced with a continuous stationary cylinder with a half inch gap between the inner diameter of the cylinder and the outer diameter of the flywheel. U.S. Pat. No. 4,886,430 also assumed that vibration would be decreased or eliminated. Again, subsequent analysis showed that the rotor was dynamically unstable, most likely due to the relatively light unit loading and thick hydrodynamic film associated with such a large radial bearing which, if too thick of a film, causes the rotor to "wander" around within the bearing.

In view of the shortcomings of the flywheel radial-bearing arrangement of the above U.S. Pat. No. 4,886,430, it was decided by the personnel of Westinghouse Electric Corporation to provide a radial bearing having a smaller radius than that discussed in U.S. Pat. No. 4,886,430 with one-quarter to one-half inch radial clearance around the outer diameter of the flywheel. This entailed placing the radial bearing adjacent to the flywheel along the shaft.

A disadvantage of this arrangement was that the overall length of the motor was increased in view of the added length of the shaft and bearing housing accommodating the radial bearing. This increase in length of the motor results in an increase in plant costs due to the increase in the depth of the pit housing the pump and to the added inventory of the water, which must be provided inside the reactor containment in order to keep the reactor core covered in the event of a break in the pipes.

Ideally, a small diameter radial bearing and a greater clearance around the outer diameter of a flywheel while still maintaining the normal length of a canned motor pump would eliminate the problems associated with the prior art. This attempt is made in the parent case bearing Ser. No. 175,866 and filed on Dec. 30, 1993 by the present inventor and assigned to Westinghouse Electric Corporation for which the present application is a continuation-in-part application.

This arrangement for a radial bearing assembly of application Ser. No. 175,866 locates the radial bearing on the shaft inside the inner circumference of the flywheel rather than on the outside diameter of the flywheel as disclosed in the U.S. Pat. No. 4,886,430, or adjacent to the flywheel as discussed hereinabove.

In application Ser. No. 175,866, the flywheel has a stepped inner circumferential surface, and the shaft has an outer circumferential surface which may carry a radial journal. This arrangement allows a radial bearing assembly to be mounted inside the inner circumference of the flywheel. The radial bearing assembly is carried by a bearing housing member which also carries a thrust bearing assembly. The bearing housing member is stationarily mounted to an inner annular member which, in turn, is stationarily fixed to an outer housing for the motor of the canned motor pump. In one embodiment, the radial bearing assembly is mounted on the bearing housing member for bearing surface contact with the inner circumferential surface of the stepped portion of the rotary flywheel assembly. In another embodiment, the radial bearing assembly is mounted on the bearing housing member for bearing surface contact with a journal on the outer circumferential surface of the rotary shaft.

This latter embodiment of application Ser. No. 175,866, where the radial bearing assembly is inside the flywheel assembly for bearing surface contact with the outer circumferential surface of the rotary shaft in a canned motor pump involves the "conventional" kind of pivoted pad radial bearings in that the radial bearing has pivoted concave bearing pads that run on the outer diameter of a rotating shaft.

For bearing loads of a high inertia rotor where the rotating inertia is about 5000 lb.-ft$^2$, a bearing diameter of about 9½ inches, such as that of FIG. 3 of application Ser. No. 175,866 is adequate. However, in a canned motor pump where certain applications require a higher rotating inertia, of say about 10,000 lb.-ft$^2$, a much longer and much heavier flywheel is needed. This would require a greater radial bearing diameter in order to support the subsequent increased bearing load.

Typically, an increase in the diameter of the radial bearing would require an increase in the inner diameter of the end of the flywheel, with a subsequent reduction in the rotating inertia.

There remains, therefore, when certain applications require an increase in the load capacity which, in turn, require an increase in the rotating inertia of a flywheel, a need not to increase the physical size of the radial bearings.

SUMMARY OF THE INVENTION

The present invention has met the above-described need. The present invention provides for a radial bearing assembly which may be located within the inner diameter of a flywheel of a canned motor pump which consists of a convex pad bearing assembly which is mounted on the outer diameter of a stationary bearing housing and which runs on the inner diameter of a rotating flywheel. The convex pad bearing assembly is comprised of pins mounted on the outer diameter of the bearing housing which support and restrain convex pads in a first embodiment of the invention or convex pad holders in a second embodiment of the invention. In the second embodiment each pin supports a convex pad holder which, in turn, supports a convex bearing pad which may preferably be made of a hard material, which may be a combination of carbon and graphite, and whose convex outer surface runs on the inner diameter of the rotating flywheel, which inner diameter surface may preferably be made of a hard metal, which may be made of a chrome plate hardened steel or hardened steel material. In the first embodiment, each pin directly supports a convex bearing pad, which may be made of a hard metal, which may be a chrome plate hardened steel or a hardened steel material, and whose convex outer surface runs on the inner diameter of the rotating flywheel, which inner diameter surface may include a sleeve made preferably of a hard material, which may be a combination of carbon and graphite.

It is a further object of the present invention to provide a radial bearing assembly located within the inner diameter of a flywheel of a canned motor pump which increases the running diameter of the bearing and therefore the peripheral speed at the bearing surfaces, resulting in an increased load capacity of the bearing.

A still further object of the present invention is to provide a radial bearing assembly located within the diameter of a flywheel of a canned motor pump and to increase the rotating inertia of the flywheel without increasing the inner diameter of the end of the flywheel which locates the radial bearing assembly, while increasing the diameter of the bearing surfaces and the load capacity of the bearing.

Another object of the present invention is to provide a radial bearing assembly, mounted in a stationary housing and located within the diameter of a flywheel of a canned motor pump, having convex spherical pads where the bearing running surfaces are the inner diameter of a rotating flywheel and the outer diameter of the bearing pads.

And yet a further object of the present invention is to provide a radial bearing assembly which is pivotally mounted to a stationary bearing housing and having a bearing member with inner and outer spherical surfaces which are convex relative to the means which mounts the bearing member to the stationary bearing housing.

BRIEF DESCRIPTION OF THE DRAWINGS

The invention will become more readily apparent from the following description of the preferred embodiment as illustrated in the accompanying drawings wherein.

DETAILED DESCRIPTION OF THE PREFERRED EMBODIMENT

The present invention finds particular application in a canned motor reactor coolant pump of a reactor primary coolant system, which operates and is constructed similar to that discussed in U.S. Pat. No. 4,886,430, which is incorporated herein by reference.

Figure 1:
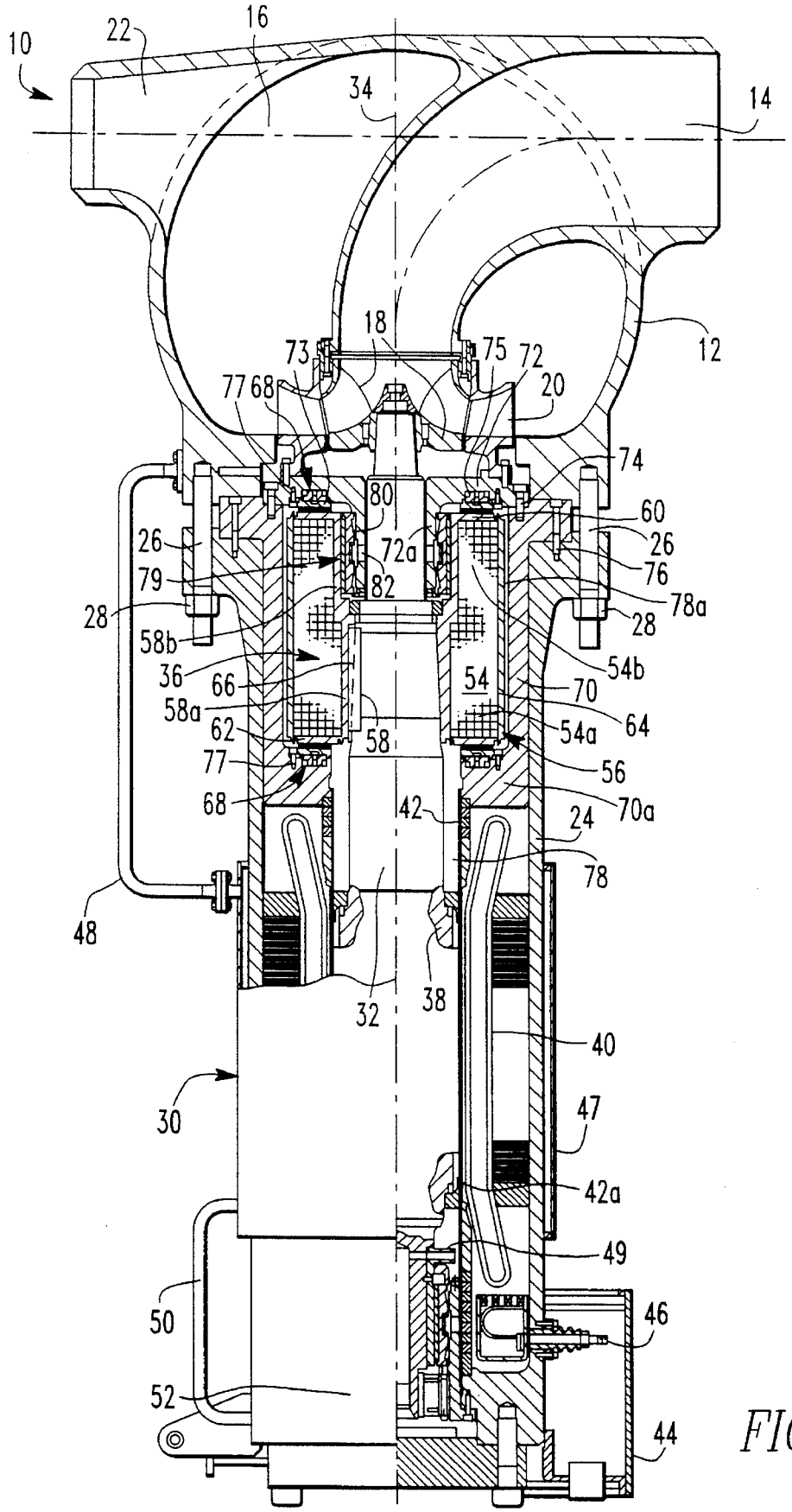
FIG. 1 is an elevational view, partially in section, of a canned motor reactor coolant pump entailing a high inertia flywheel with a radial bearing assembly with a convex pivoted pad bearing assembly of the present invention.

Referring to FIG. 1, there is shown a canned single-stage centrifugal reactor coolant pump 10. The pump 10 includes a pump casing 12 defining suction section 14 and discharge section 16, and having an impeller 18 for centrifugally pumping the coolant fluid, whereby water is drawn through the eye of the impeller, discharged through the diffuser 20 into the pump casing 12 and out through the discharge nozzle 22 in the side of the casing 12.

Pump 10 includes a housing 24 removably mounted to the pump casing 12 by a plurality of studs 26 and nuts 28. Pump 10 further includes a motor 30 for driving impeller 18 via a rotatable shaft 32 about pump centerline axis 34, and a high inertia flywheel assembly 36 mounted on shaft 32 between motor 30 and impeller 18 for mechanical storage of potential energy to be used to continue to rotate shaft 32 if motor 30 becomes de-energized.

Motor 30 has a rotor assembly 38 mounted on shaft 32, a stator assembly 40, and a corrosion resistant stator can 42 separating the stator assembly 40 from the rotor assembly 38, defining the fluid pressure boundary within the pump 10 and also defining a narrow annulus of fluid between the stator can 42 and the outer diameter of the rotor assembly 38. Electrical connections are made in the terminal box 44, with connections to the stator assembly 40 passing through the housing 24 via terminal assemblies 46.

Pump 10 also includes a water jacket 47 for receiving a coolant water flow through cooling pipes 48 and 50 for keeping the internal temperature of motor 30 relatively cool at about 150° F. for a heavy water reactor facility.

Fluid, at a total flow rate of about 150 gpm, is passed from the casing 12 to the jacket 47 through cooling pipe 48. The fluid flows through jacket 47 into cooling pipe 50, then to the lower end 52 of motor 30. It is then passed through the rotor assembly 38 and an annulus **42*a* of stator can 42, being circulated by a small centrifugal auxiliary pump impeller 49, the details of which are not necessary for an understanding by those skilled in the art. After passing flywheel assembly 36 as described below, the fluid is returned to casing 12. Stator assembly 40 lies outside of stator can 42 and inside housing 24, this area normally being dry. However, housing 24 is designed such that a breach of stator can 42 will not cause failure or leakage of fluid from motor housing 24**.

Flywheel assembly 36 will now be discussed in greater detail with particular reference to FIGS. 1 and 2. Flywheel assembly 36 comprises a disk 54, which is preferably made of a metal having very high density and specific gravity, such as uranium, tungsten, or an alloy of one of these elements, chosen such as to yield the desired strength and inertia. The type of metal chosen will preferably have a high yield strength, such as in excess of about 60,000 psi; and should be non-brittle, so that the extreme forces exerted on the disk 54 from rotation will not cause failure or excessive deformation of the disk 54. One preferable embodiment is uranium alloy with about 2 percent by weight molybdenum, a high density alloy having a minimum yield strength of about 65,000 psi and an elongation of about 22 percent.

In the embodiment described herein, disk 54 has an outer diameter of about 26 inches to 30 inches and, preferably 28 inches. A lower portion of disk 54 indicated at **54*a* has an inner diameter of about 8 inches to 10 inches, and preferably 9 inches, and an upper portion 54*b* of disk 54 has an inner diameter of about 15 to 17 inches, and preferably 16 inches. The total length of disk 54 is about 27 to 29 inches and preferably 28 inches. The length of lower portion 54*a* of disk 54 with the smaller inner diameter is about 14 to 16 inches, and the length of upper portion 54*b* with the larger inner diameter is about 12 to 14 inches. Lower portion 54*a* and upper portion 54*b* of disk 54 are such that they form a stepped configuration for the inner diameter of disk 54**.

Disk 54 is enclosed in a stainless steel shell 56 comprised of an inner diameter annular plate 58 disposed around shaft 32 for mating with shaft 32, a first end plate 60, a second end plate 62, and an outer circumferential plate 64. Plates 58, 60, 62 and 64 are welded together to sealably enclose disk 54, thereby preventing corrosion or erosion of the heavy metal.

Inner diameter plate 58 has a lower portion **58*a* and an upper portion 58*b* having different inner and outer diameter to form a stepped configuration to mate with the stepped portions 54*a* and 54*b* along the inner diameter of disk 54. The inner diameter of lower portion 58*a* of annular plate 58 mates with and is keyed by one or more keys 66 to shaft 32**, as is known to those skilled in the art for joining flywheels to shafts.

The first end plate 60 and the second end plate 62 lie generally perpendicular to shaft 32, and the surfaces are used as thrust runners. As such, thrust bearing means 68 are disposed on an outer annular member 70 and an inner annular member or bearing housing member 72, which are interconnected by a plurality of bolts 74, and which outer annular member 70 is stationarily fastened to housing 24 by a plurality of bolts 76. Bearing housing members 70 and 72 and housing 24 are stationarily fixed, and allow shaft 32 and flywheel assembly 36 to rotate within assembled bearing housing members 70 and 72 and housing 24.

The lower portion **70*a* of outer annular bearing housing member 70 is connected to the top part of stator housing 24 to form part of an annular channel opening 78 around shaft 32 and an annular channel 78*a* around flywheel assembly 36**, into which the coolant flows.

Thrust bearing means 68 at both ends of disk 54 flywheel assembly 36 are disposed to mate with plates 60 and 62, and includes a plurality of thrust bearing shoes 73 on each side of the flywheel assembly 36 which are mounted to outer annular bearing housing member 70 and inner annular bearing housing member 72 by thrust links 75 and thrust shoe retainers 77. Thrust links 75 generally include primary and secondary links which provide self levelling and load equalization for the thrust bearing shoes 73, which is common in the art, and does not need to be derailed for a through understanding of the present invention. Thrust bearings 68 absorb forces exerted along the longitudinal axis of pump 10 and minimize movement along the axis 34 of rotary shaft 32.

Referring to flywheel assembly 36 and the inner diameter plate 58, the inner circumferential area of disk 54 has a stepped configuration with inner diameter plate 58 conforming to the same stepped configuration, with upper portion 58*b* being utilized as a radial journal and mating with radial bearing means 79 which are mounted around a lower portion 72*a* of radial bearing housing member 72 which also houses thrust bearing means 68.

Figure 2:
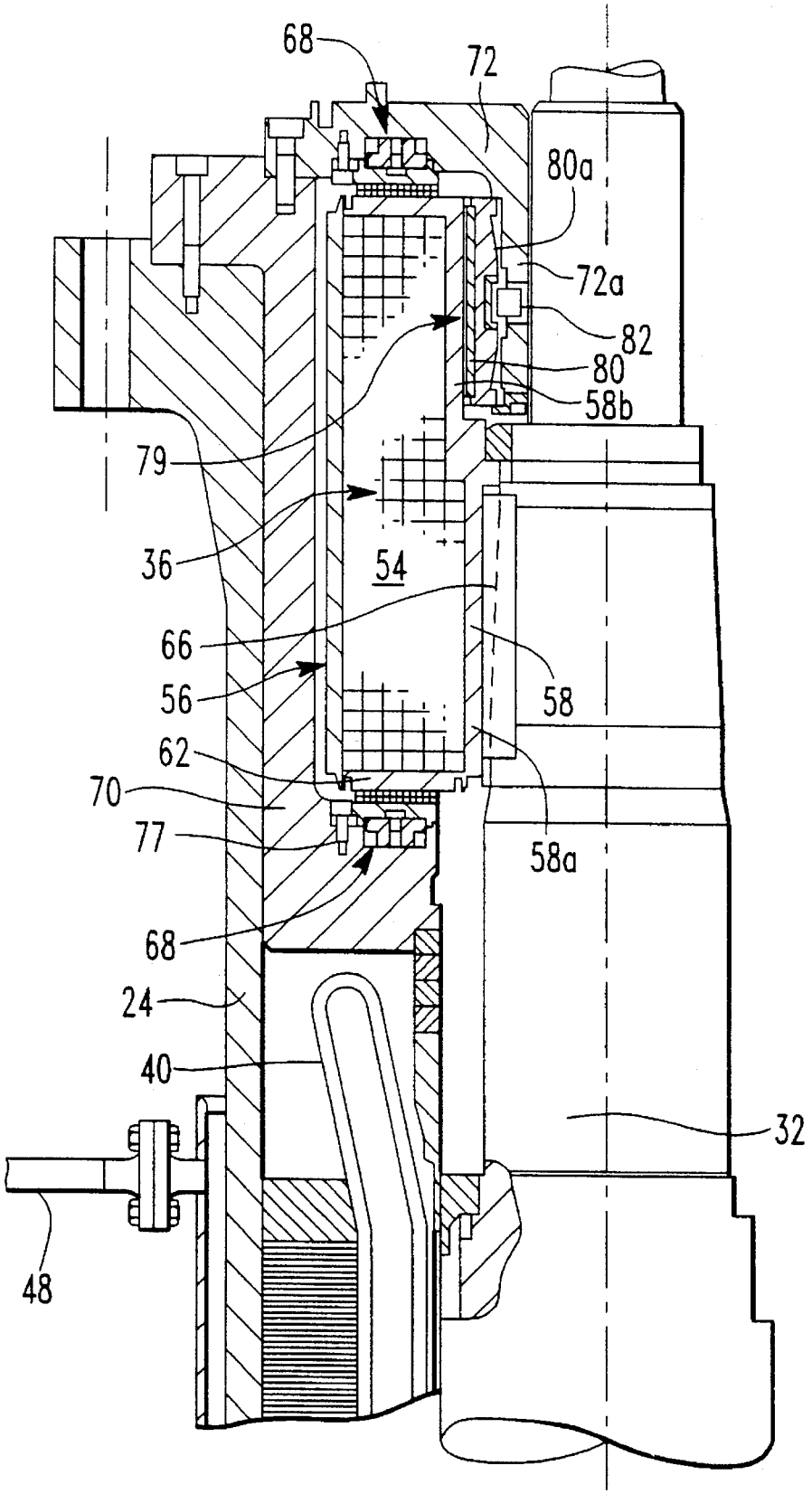
FIG. 2 is an enlarged cross-sectional, partial view showing the flywheel and the radial bearing assembly as viewed to the left of the centerline of the rotary shaft in FIG. 1.

As best shown in FIG. 2, radial bearing means 79 is comprised of a plurality of radial pad assemblies or bearing segments 80 and bearing member 80*a* disposed about the periphery of the lower portion 72*a* of inner annular member or bearing housing 72. Each segment 80 and bearing member 80*a* is mounted to inner annular member 72 by precipitation hardened stainless steel radial pivot pins 82 which allow vertical and circumferential tilt capability for alignment and hydrodynamic film generation between segment 80 and bearing member 80*a* and upper portion 58*b* of inner diameter plate 58.

The thrust bearing means 68 may also be of the Kingsbury type, and the radial bearing means 79 may be of the continuous cylinder type, which are well-known in the art.

From the foregoing, it is appreciated that inner annular bearing housing member 72 houses both the thrust bearing means 68 for top plate 60 of flywheel assembly 36 and radial bearing means 79 for integrally mounting thrust bearing means 68 and radial bearing means 79 in motor 30. Additionally, the radial clearance between inner annular bearing housing member 72 and flywheel assembly 36 is about 0.25 inches to about 0.50 inches and, preferably, 0.318 inches to provide an optimum clearance for producing low friction therebetween.

Figure 3:
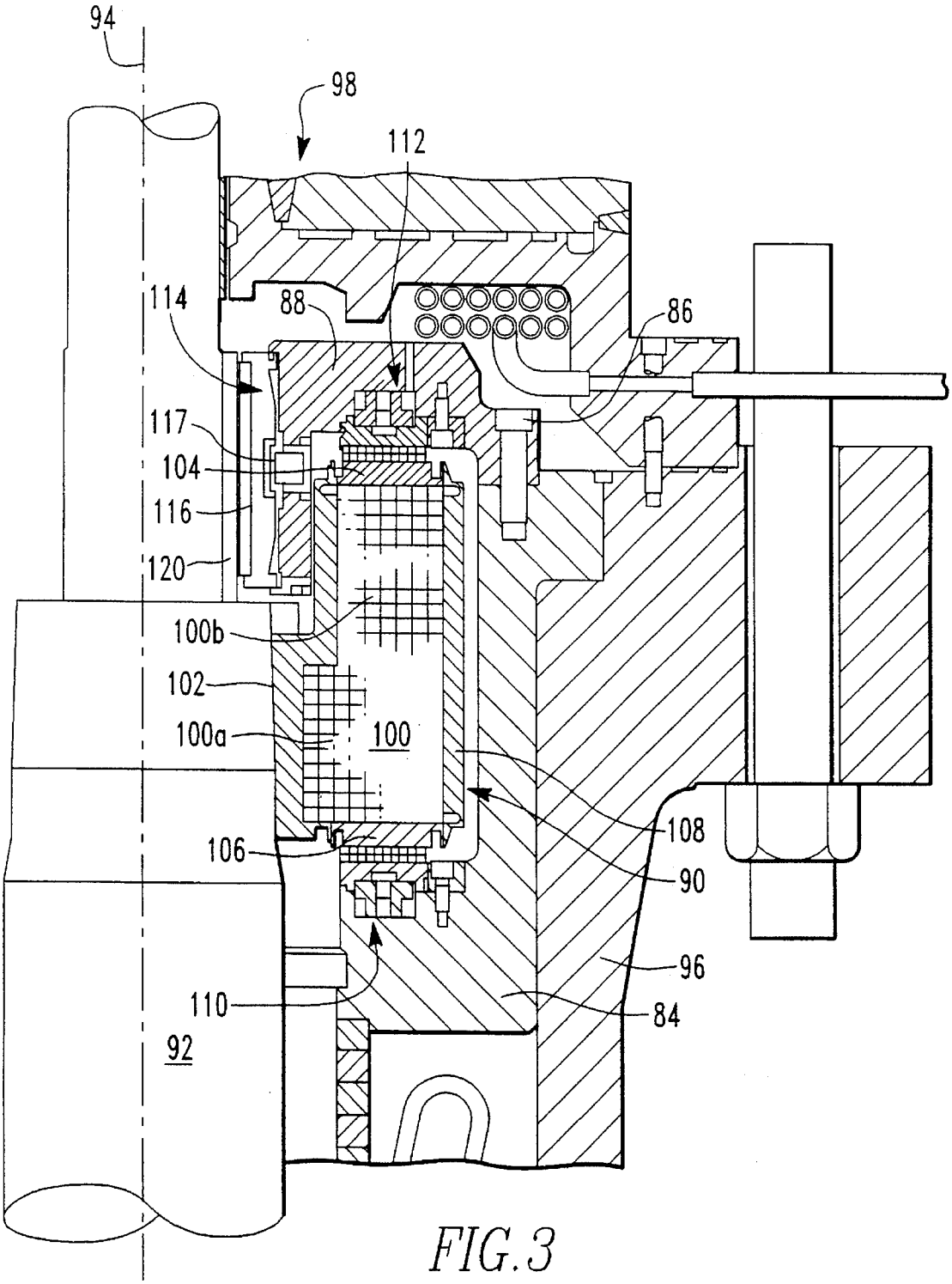
FIG. 3 is an enlarged, cross-sectional partial view of a canned reactor coolant pump showing a high inertia flywheel with a radial bearing assembly as viewed to the right of the centerline of a rotary shaft of a coolant pump similar to that in FIG. 1, and which radial bearing assembly has a "conventional" type of concave, pivoted pad bearing assembly.

FIG. 3 shows the structural arrangement and location for a radial bearing assembly employing the "conventional" type of radial bearing assembly which has concave pivotal pads. This embodiment comprises an outer annular housing member 84 fastened by bolts 86 to an inner annular bearing housing member 88, which members 84 and 88 cooperate to encase a flywheel assembly 90 mounted for rotation on rotary shaft 92 along a centerline axis 94 for rotation in outer housing 96 of a canned pump 98. Flywheel assembly 90 has a disk 100 with stepped portions 100*a* and 100*b* encased in an inner diameter annular plate 102 with stepped portions, a first end plate 104, a second end plate 106, and an outer annular member 108, similar to that of flywheel assembly 36 of FIGS. 1 and 2.

Outer annular housing bearing member 84 carries a thrust bearing assembly 110, and inner annular housing bearing member 88 carries a thrust bearing assembly 112 and a radial bearing assembly 114. Radial bearing assembly 114 is comprised of several bearing pads or segments 116 pivotally mounted by pins 117 to bearing housing member 88. These bearing pads or segments 116 are the "conventional" kind of pivoted pad bearings in that segments 116 are concave relative to pivot pin 18. A plain or full cylinder bearing may be used instead of the bearing pads or segments in a fashion well-known in the art. The shaft 92 carries a journal member 120, which acts as a contact bearing surface for radial bearing assembly 114.

In this embodiment of FIG. 3, the flywheel assembly 90 and the shaft 92 with journal member 120 rotate while the remaining components remain stationary. Also, as can be appreciated, the radial bearing assembly 114 is mounted inwardly of inner annular bearing housing member 88 for surface bearing contact with journal member 120 on the shaft 92, whereas in the embodiment of FIGS. 1 and 2, the radial bearing assembly 79 is mounted outwardly of bearing housing member 72 for surface bearing contact with flywheel assembly 36. However, both embodiments of these FIGS. 1–3 locate the radial bearing assemblies 79 and 114 within the inner diameter of its respective flywheel assembly 36 and 90.

It can also be appreciated that in the embodiment of FIGS. 1–2, both the thrust bearing assembly 68 and the radial bearing assembly 79 are mounted or carried by stationary bearing housing member 72, and that in the embodiment of FIG. 3, both thrust bearing assembly 112 and radial bearing assembly 114 are mounted in the same stationary bearing housing 88.

The mounting of radial bearing means 79 and 114 within the inner circumference of flywheel assemblies 36 and 90, respectively, reduces the rotor and, therefore, the motor length, and the span between the radial bearings allows high speeds of the rotor and flywheel assemblies 36 and 90, say about 1800 to 3600 revolutions per minute, and provides higher rotor critical speed compared to the radial bearing being located adjacent to the outer surface of the flywheel, as discussed hereinabove as being prior art, and better rotor dynamic stability due to the more appropriate film thickness than when the radial bearing is located on the outer diameter of the flywheel as discussed hereinabove as being prior art.

Figure 4:
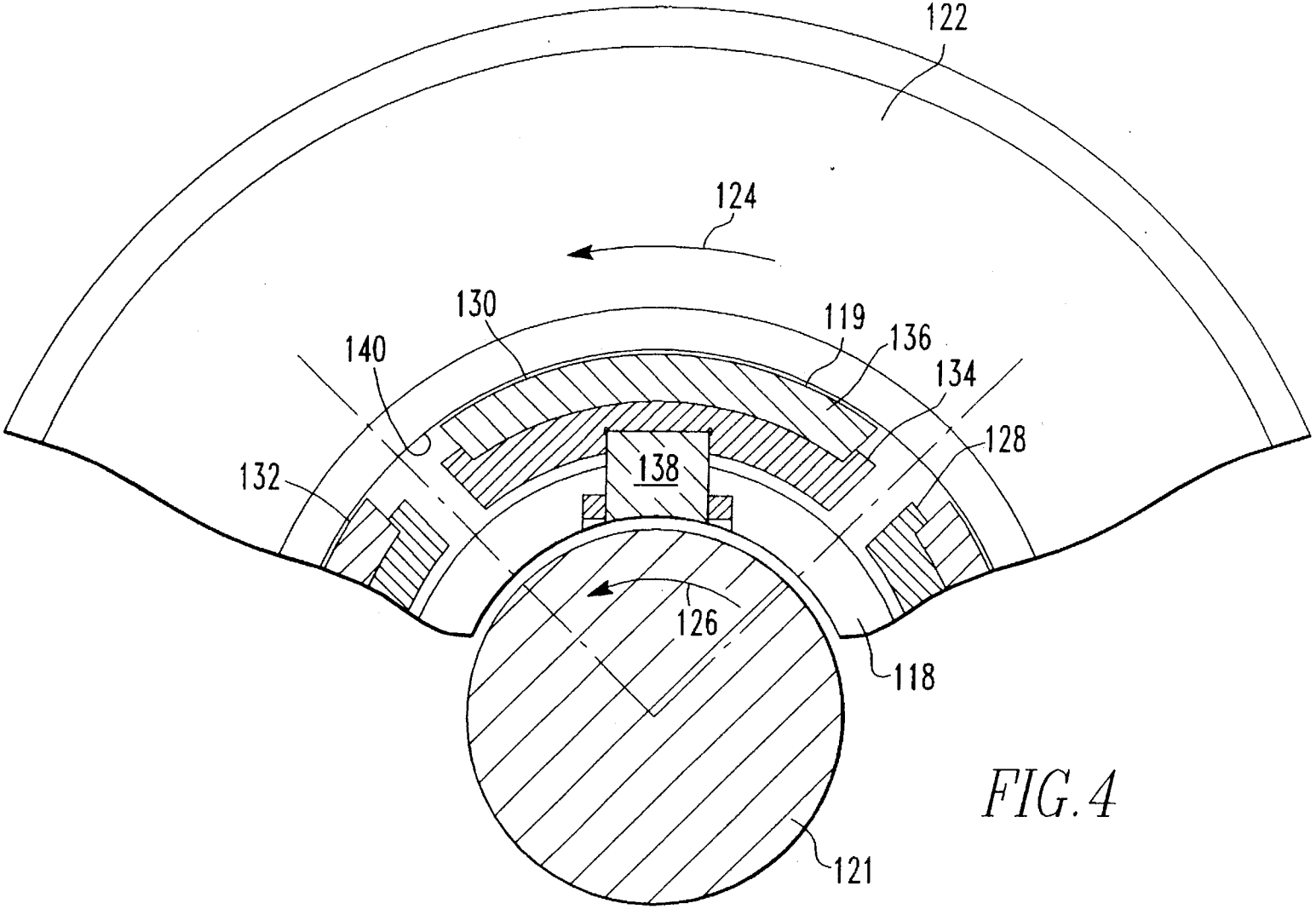
FIG. 4 is a partial transverse, schematic detail view of a first embodiment of the convex, pivoted pad radial bearing assembly of the present invention, the location of which radial bearing assembly is shown in FIGS. 1 and 2.

FIG. 4 schematically shows a first embodiment for a convex radial bearing assembly 119 of the present invention mounted to a bearing housing 118. The construction, arrangement, and/or operation of bearing housing 118, shaft 121, and flywheel 122 of FIG. 4 would be similar to annular bearing housing member 72, shaft 32, and flywheel 54, respectively, of FIGS. 1 and 2, and shaft 121 along with flywheel 122 rotates, for instance, in the direction indicated by arrows 124 and 126, while bearing housing 118 remains stationary.

Radial bearing assembly 119 consists of several bearing pad means arranged circumferentially around shaft 121, and around the outer circumference of bearing housing 118, and some of which bearing pad means are indicated at 128, 130, and 132.

Each bearing pad means 128, 130, and 132 is constructed similarly, and will be explained with reference to bearing pad means 130. Bearing pad means 130 consists of a convex pad holder 134 mounted by pivot pin 138 to bearing housing 118 and a convex pad 136, carded by pad holder 134 as discussed hereinabove with regard to radial bearing means 79 of FIGS. 1 and 2. Pad holder 34 may be made of steel. Pivot pin 138 may be made of precipitated hardened stainless steel and pivot pin 138 may be spherical and attached to pad holder 134 and bearing housing 118 in a manner which allows vertical and circumferential tilt capability for pad holder 134 and pad 136 relative to the inner circumferential surface 140 of flywheel 122.

Convex pad 136, preferably, is made of a hard material, which may be a combination carbon and graphite material.

Inner circumferential surface 140 of flywheel 122 may be part of a journal sleeve similar to bearing segment 80 clearly shown in FIG. 2, and preferably, may be made of a hard metal, which may be a chrome plate hardened steel or hardened steel material.

Figure 5:
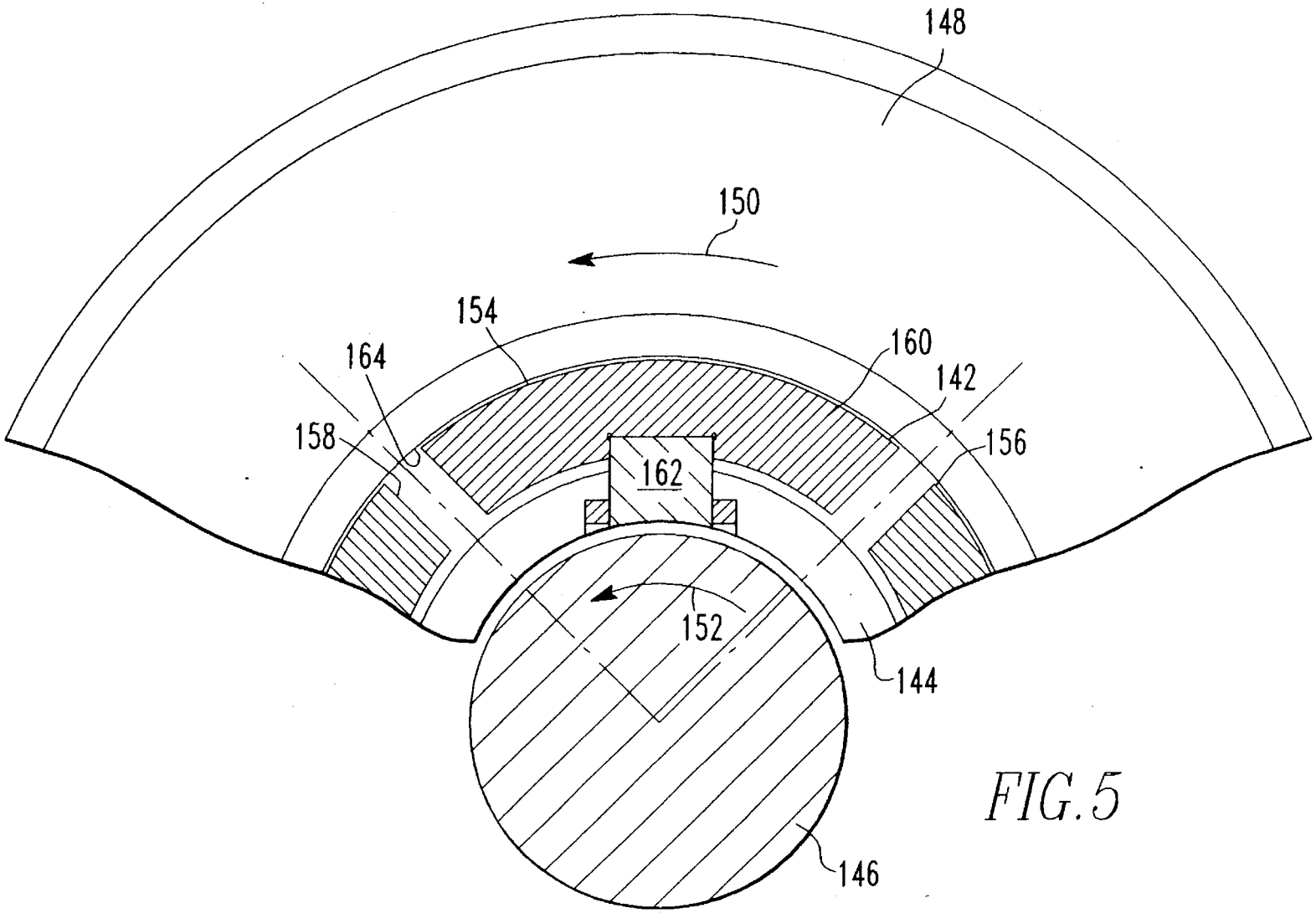
FIG. 5 is a partial transverse, schematic detail view of a second embodiment of the convex, pivoted pad radial bearing assembly of the present invention, the location of which radial bearing assembly is shown in FIGS. 1 and 2.

Referring now to FIG. 5, a second embodiment for the present invention provides a convex radial bearing assembly 142 mounted to a bearing housing 144, which is stationarily mounted in a canned motor pump of FIGS. 1 and 2, similarly to that of the first embodiment of FIG. 4. Here again, the construction, arrangement, and/or operation of bearing housing 144, shaft 146, and flywheel 148 of FIG. 5 would be similar to that of FIGS. 1 and 2. Flywheel 148, connected to shaft 146 may rotate in the direction indicated by arrows 150 and 152 about stationary bearing housing 144.

Radial bearing assembly 142 consists of several bearing pad means arranged circumferentially around shaft 146 and around the outer circumference of bearing housing 144, and some of which bearing pad means are indicated at 154, 156, and 158.

Each bearing pad means is similarly constructed, and will be explained with reference to bearing pad means 154.

Bearing pad means 154 consists of a convex pad 160 pivotally mounted by a pivot pin 162 to bearing housing 144. Pad 160 may be of a solid metal construction. Pivot pin 162 may be spherical and attached to pad 160 and bearing housing 144 in a manner which allows vertical and circumferential tilt capability for pad 160 relative to inner circumferential surface 164 of flywheel 148. Pivot pin 162 may be made of a precipitation hardened stainless steel.

Inner circumferential surface 164 of flywheel 148 may be part of a journal sleeve similar to bearing segment 80 clearly shown in FIG. 2 and, preferably, may be made of a hard material, which may be a combination of carbon and graphite and, preferably, convex pad 160 may be made of a hard metal, which may be a chrome plate hardened steel or hardened steel material. The combination carbon-graphite material is available under the name of Graphitar® or Pure-bon®, and the chrome plate hardened steel or hardened steel material is available under the name of Stellite®. Graphitar® is made by the U.S. Graphite Co. of Saginaw, Mich., and Pure-bon® is made by the Pure Carbon Co. in St. Mary's, Pa., and both are self-lubricating materials. Stellite® is owned by the Deloro Stellite Company, St. Louis, Mo. These materials are well-known to those skilled in the art, and have typically been used for several years as bearing running surfaces for bearing assemblies.

Other kinds of material such as titanium carbide or tungsten carbide, for the bearing running surfaces of the embodiments of FIGS. 4 and 5 can be used instead of that discussed hereinabove. Also, a glass impregnated teflon can be used instead of the combination carbon and graphite material. The important thing is that, preferably, the bearing running surfaces of the embodiments of FIGS. 4 and 5 be hard-on-hard surfaces, with one of the surfaces having self-lubricating properties.

The type of pivotal pad bearings for bearing assemblies 128, 130, 132, and 154, 156, and 158 of FIGS. 4 and 5, respectively, are well-known to those skilled in the art, and may be those referred to as segmented, pad radial bearings, manufactured and sold by Westinghouse Electric Corporation.

In the arrangement of FIG. 3, the radial bearing assembly 114 employs the "conventional" type of pivotal pad bearings which are concave, whereas the arrangement of FIGS. 1 and 2 employ convex pivotal pad bearings as that shown in FIGS. 4 and 5. These terms "concave" and "convex" refer to the outer peripheral surfaces of the bearing pads when considered relative to the pivotal pin which attaches the bearing pad to the stationary bearing housing.

As discussed hereinabove, the "concave" type of radial bearing assembly 114 of the arrangement of FIG. 3 where the pivotal pad bearings engage the outer diameter of the shaft 92, an effective 9½ inch bearing diameter is generally adequate to handle an inertial load of about 5,000 lb-ft$^2$. The length of flywheel 100 of this arrangement may be about 14 inches and its weight may be about 5,000 lbs. However, when the length and weight of the flywheel of a canned motor pump is increased such as the flywheel 54, 122, 148 of FIGS. 2–5, in order to handle an increase in the inertial load to about 10,000 lb.-ft$^2$, then a 14 inch bearing diameter having the convex type of radial bearing assemblies 116 and 142, proves to be adequate.

The load capacity of a 14 inch effective bearing diameter approximately doubles that of a 9½ inch bearing diameter. This is due in part to an increased bearing area and, in part, to an increased peripheral speed. If extra load capacity is not needed, a smaller bearing diameter could be used, which would allow a smaller flywheel inner diameter, which would result in more rotating inertia for the same flywheel outer diameter and length. A smaller flywheel inner diameter provides a greater volume of high density material providing a greater flywheel weight and inertia for the same flywheel outer diameter.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A canned motor pump having an impeller, said motor pump comprising:

a rotatable shaft assembly, drive means in engagement with said shaft assembly for turning said impeller, a flywheel assembly mounted on said shaft assembly with an annular recess between one end of said flywheel assembly and said shaft assembly forming an inner circumferential running surface means, radial bearing means located in said annular recess and having outer circumferential running surface means for engagement with said inner circumferential running surface means of said flywheel assembly, and bearing housing means for carrying said radial bearing means and for locating said radial bearing means in said annular recess, said radial bearing means having convex pad means for said engagement of said radial bearing means with said inner circumferential running surface means of said flywheel assembly.

2. A pump of claim 1, wherein said bearing housing means has an outer circumferential surface and wherein said radial bearing means is pivotally mounted on said outer circumferential surface of said bearing housing means.

3. A pump of claim 2, wherein said bearing housing means is stationary and wherein said shaft assembly and said flywheel assembly are rotatable.

4. A pump of claim 1, wherein said radial bearing means consists of bearing surfaces forming said outer circumferential running surface means and wherein said outer circumferential running surface means of said radial bearing means and said inner circumferential running surface means of said flywheel assembly are made of a hard material and wherein said hard material of at least one of said running surface means has self-lubricating properties.

5. A pump of claim 1, wherein said radial bearing means consists of a pad assembly having a pad holder and pad means forming said outer running circumferential surface means of said radial bearing means.

6. A pump of claim 5, wherein said pad means is made of a material which is a combination of carbon and graphite, and wherein said inner circumferential running surface means of said flywheel assembly is made of a type of hardened steel material.

7. A pump of claim 1, wherein said radial bearing means consists of a pad assembly having pad means consisting of said outer circumferential running surface means, and wherein said inner circumferential running surface means of said flywheel assembly is a sleeve member.

8. A pump of claim 7, wherein said pad means is made of a type of hardened steel material, and wherein said sleeve of said flywheel assembly is made of a material which is a combination of graphite and carbon.

9. A radial bearing assembly disposed between a stationary assembly with outer circumferential running surface means, and a rotating assembly having inner circumferential running surface means, said radial bearing assembly comprising:

a bearing housing mounted on said stationary assembly, convex bearing pad means comprising pad elements pivotally mounted to said bearing housing and forming said outer circumferential running surface means of said stationary assembly, and a sleeve member forming said inner circumferential running surface means of said rotating assembly.

10. A radial bearing assembly of claim 9, wherein said pad element and said sleeve member have bearing surfaces made of a hard material, and wherein said hard material of at least one of said bearing surfaces has self-lubricating properties.

11. A machine, comprising:

a stationary assembly, a rotatable shaft assembly, drive means in engagement kith said shaft assembly for rotating said shaft assembly, a flywheel assembly having inner circumferential running surface means and mounted on said shaft assembly for rotation therewith, and radial bearing means mounted in said stationary assembly and having outer circumferential running surface means for engagement with said inner circumferential running surface means of said flywheel assembly, said radial bearing means having convex pad means for said engagement of said outer circumferential running surface means of said radial bearing means with said inner circumferential running surface means of said flywheel assembly.

12. A machine of claim 11, wherein said stationary assembly has outer circumferential surface means and wherein said radial bearing means is pivotally mounted on said outer circumferential surface means of said stationary assembly.

13. A machine of claim 11, wherein said radial bearing means consists of bearing surfaces forming said outer circumferential running surface means and wherein said outer circumferential running surface means of said radial bearing means and said inner circumferential running surface means of said flywheel assembly are made of a hard material, and wherein said hard material of at least one of said running surface means has self-lubricating properties.

14. A machine of claim 11, wherein said radial bearing means consists of a pad assembly having a pad holder and pad means forming said outer circumferential running surface means of said radial bearing means.

15. A machine of claim 14, wherein said pad means is made of a material which is a combination of carbon and .graphite, and wherein said inner circumferential running surface means of said flywheel assembly is made of a type of hardened steel material.

16. A machine of claim 11, wherein said radial bearing means consists of a pad assembly having pad means consisting of said outer circumferential running surface means, and wherein said inner circumferential running surface means of said flywheel assembly is a sleeve.

17. A machine of claim 16, wherein said pad means is made of a type of hardened steel material, and wherein said sleeve of said flywheel assembly is made of a material which is a combination of graphite and carbon.

* * * * *